United States Patent [19]

Meinke

[11] 4,377,362

[45] Mar. 22, 1983

[54] DEVICE FOR BUNDLING FIREWOOD

[76] Inventor: Herman E. Meinke, Rte. 3, Boswell, Okla. 74003

[21] Appl. No.: 226,031

[22] Filed: Jan. 19, 1981

[51] Int. Cl.[3] ..... B65G 57/18

[52] U.S. Cl. ..... 414/43; 53/592; 100/2; 100/8; 211/60 R; 414/97; 414/764

[58] Field of Search ..... 414/28, 29, 38, 43, 414/48, 97, 680, 681, 745, 748, 754, 764, 765, 766, 777, 778; 100/1, 2, 7, 8; 211/60 R; 298/10; 53/399, 582, 590, 592

[56] References Cited

U.S. PATENT DOCUMENTS

| | | | |
|---|---|---|---|
| 1,128,671 | 2/1915 | Evans | 414/38 |
| 1,307,255 | 6/1919 | Hookey | 414/764 X |
| 1,694,591 | 12/1928 | Grady | 414/43 X |
| 3,937,333 | 2/1976 | Tucker et al. | 414/777 |
| 4,057,262 | 11/1977 | Boon | 414/764 X |

FOREIGN PATENT DOCUMENTS

| | | | |
|---|---|---|---|
| 98668 | 4/1940 | Sweden | 100/7 |
| 222255 | 8/1968 | Sweden | 414/680 |
| 150415 | 9/1961 | U.S.S.R. | 414/764 |
| 476210 | 11/1975 | U.S.S.R. | 100/2 |

*Primary Examiner*—Leslie J. Paperner

*Attorney, Agent, or Firm*—Head, Johnson & Stevenson

[57] ABSTRACT

An apparatus for bundling short lengths of cylindrical items, such as firewood, the apparatus being formed of a frame for resting on the earth, with a semi-circular bottom rack rotatably supported by the frame about its horizontal axis and normally retained in an upper open position, a semi-circular top rack of the same internal dimensions removably attachable to the bottom rack to form, when the two parts are attached, a circular area in which firewood may be stacked and retained so that a band may be secured around the stacked wood, after which the semi-circular top rack may be removed, and means for rotating the bottom rack about its horizontal axis so that the banded cylindrical bundle of firewood can be removed from the rack.

3 Claims, 7 Drawing Figures

DEVICE FOR BUNDLING FIREWOOD

BACKGROUND OF THE INVENTION

1. Field of the Invention

This invention relates to an apparatus for use in bundling cylindrical objects of short lengths, such as firewood. In the past, it has been customary to deliver firewood in loose form; that is, where it is handled a stick at a time. Typically, the firewood is stacked in racks formed by upstanding posts. Such means of transporting and handling firewood is expensive in that it requires a great deal of manual labor.

The present invention is directed towards a device permitting more expeditious handling of firewood.

2. Description of the Prior Art

As above indicated, the most common means of handling firewood is in loose form, that is, individual sticks which are separately, and usually manually, loaded and unloaded as the wood is transported from the area where the firewood is cut to where it is used. The present invention is a means of bundling the firewood so it can be handled in the form of bundles rather than a stick at a time.

It is well known to band a plurality of items together to form a unitary item. However, to the present time, no means of bundling firewood has been developed which has achieved widespread application.

It is therefore an object of this invention to provide an improved means of bundling short lengths of cylindrical items such as firewood.

More particularly, an object of this invention is to provide a means for bundling firewood in a manner to produce a round bundle in an expeditious way, the bundle encompassing a preselected quantity of wood which may be subsequently transported using forklift trucks and, in which the bundle is in a cylindrical form so that it may be easily rolled from one location to another.

These general objects as well as other and more specific objects of the invention will be fulfilled in the following description and claims, taken in conjunction with the attached drawings.

SUMMARY OF THE INVENTION

An apparatus is described for use in bundling short lengths of cylindrical objects, such as firewood. The device includes a frame which has a base for resting on the earth's surface. The frame includes a horizontal portion which engages the earth, and at one end, a vertical portion. A first bearing means is provided on the frame intermediate its length and a second bearing means is provided on the frame vertical portion adjacent the upper end thereof. Rotatably supported about its horizontal axis on the frame first and second bearing means is a lower semi-circular rack. The lower rack is normally supported on the frame so as to be open at the top. Removably attachable to the lower rack is a semi-circular upper rack of internal dimensions substantially equal to that of the lower rack. With the upper rack portion in position on the lower rack, a circular confined area is provided in a vertical plane in which firewood may be stacked to completely fill the interior of the defined area.

After the area defined by the semi-circular upper and lower racks is filled with firewood, it may be banded together by encircling the stacked firewood using two bands. After the bands are secured in position, the upper rack may be removed so that the banded circular bundle of firewood rests in the lower rack. To discharge the bundle, means are provided for rotating the bottom rack about its cylindrical axis. The preferred means includes the use of a winch having a retractable cable; the cable being attached to the bottom rack. The winch is supported on the frame vertical portion adjacent its upper end and on the side thereof opposite the bottom rack. When the winch is rotated to wind cable thereon, the bottom rack is pivoted about its horizontal axis so that the banded bundle of firewood will roll out of the lower rack. The round bundle may then be easily rolled from one location to another and may be loaded on a truck for transportation by the use of a forklift.

DETAILED DESCRIPTION OF THE PREFERRED EMBODIMENTS

Figure 1:
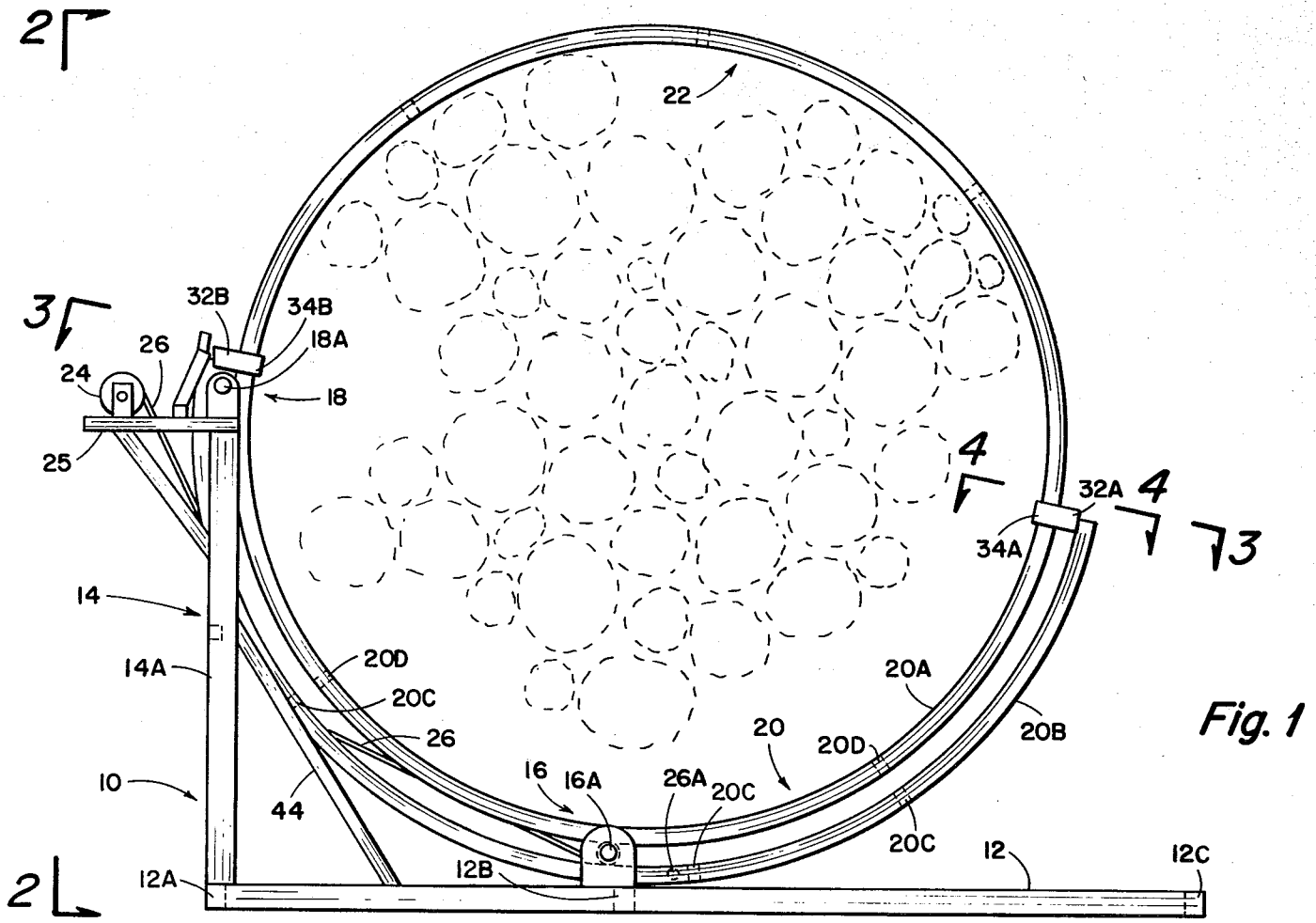
FIG. 1 is a front elevational view of an embodiment of the invention showing the top rack in position on the bottom rack forming a confined circular area in which firewood is stacked and in which condition the firewood may be banded to form a round bundle.

Referring to the drawings and first to FIG. 1, an elevational side view of a preferred embodiment of the invention is shown. A frame, generally indicated by the numeral 10, includes a base 12 for resting on the surface of the earth, the base forming a frame horizontal portion. Affixed to one end of the base 12 is a vertical portion 14.

Extending upwardly from the base horizontal portion at a point intermediate its length is a first bearing support 16. Affixed to the frame vertical portion 14 adjacent its upper end is a second bearing support 18.

Rotatably supported on the frame 10 by means of the first and second bearing supports 16 and 18 is a bottom rack 20. The bottom rack is of semi-circular configuration and is supported in a vertical plane with its semi-circular axis being horizontal.

Removably attached to the bottom rack 22 is a semi-circular rack or top rack 22, which has substantially the same internal diameter as the bottom rack 20. When the top rack is attached to the bottom rack as shown in FIG. 1, a circular area is defined in which firewood or other cylindrical objects can be stacked. Throughout this application reference will be made for its use in bundling firewood, it being understood that any other items of similar nature can be bundled employing the device.

In a preferred practice, the diameter of the circled area formed by top and bottom racks is about 58 inches, so that the area will receive the equivalent of one-half rick of firewood.

Affixed to the frame vertical portion 14 adjacent the upper end thereof is a winch 24 having a cable 26 extending therefrom, one end 26A of the cable being attached to the bottom rack 20.

In the condition as shown in FIG. 1, the apparatus is ready to receive firewood stacked therein. After the wood is stacked to completely fill the area defined by the top and bottom racks 20 and 22, it may be banded by placing bands of steel or other flexible material around the wood and securing the ends of the bands together.

Figure 6:
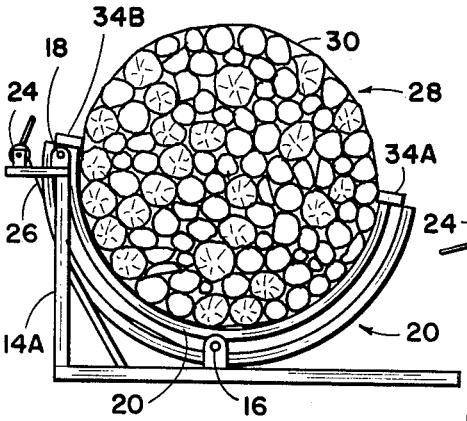
FIG. 6 is a reduced dimensioned elevational view of the apparatus showing firewood having been stacked therein and banded with the top rack removed.

FIG. 6 shows a bundle of firewood 28 having bands 30 thereon, only one band being shown. The bands are preferably spaced apart from each other to be adjacent the outer ends of the length of the sticks of wood making up the bundle 30. In FIG. 6 the top rack 22 has been removed. To discharge the bundle of firewood 28 from the bottom rack 20, cable 26 is wound on winch 24 to rotate the bottom rack 20 on the first and second bearing supports 16 and 18 to the position shown in FIG. 7. This causes the bundle of firewood 28 to roll out of the bottom rack. It can be seen that it is easy to move the bundle of firewood about because of its circular shape. In addition, in order to transport the bundle of firewood, it can be lifted by a fork truck onto a vehicle so that a large number of pieces of firewood may be moved quickly and expeditiously by one operator instead of handling the individual sticks of firewood separately as is the present practice.

Figure 2:
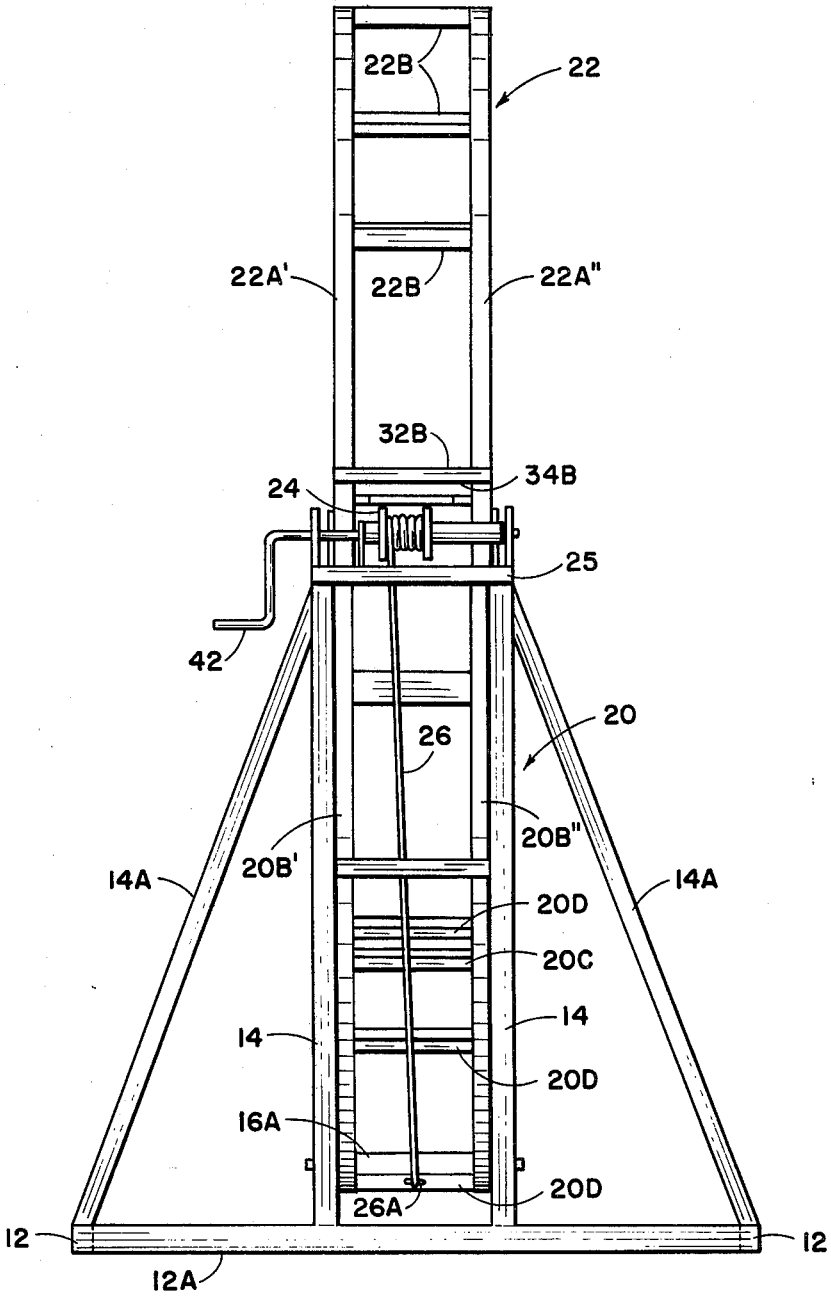
FIG. 2 is an end elevational view taken along the line 2—2 of FIG. 1.
Figure 3:
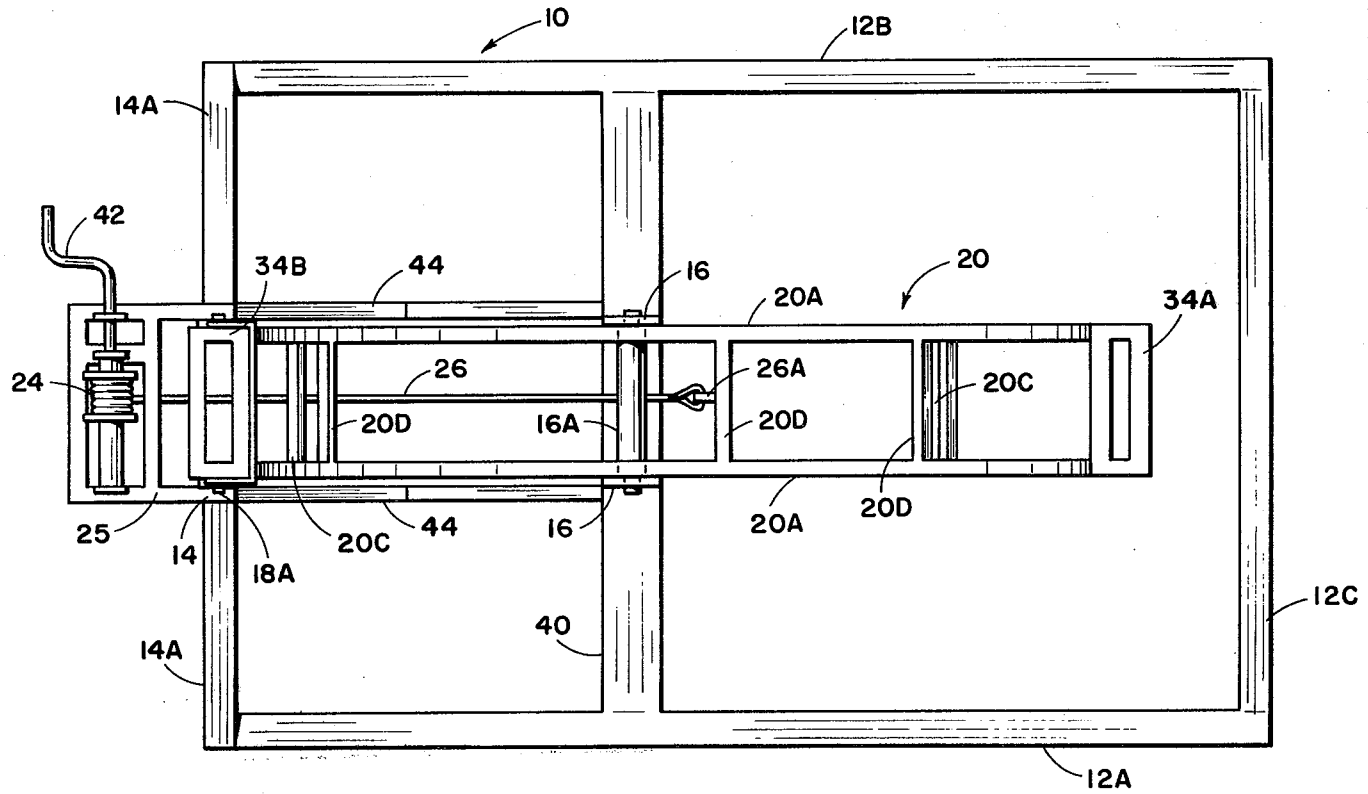
FIG. 3 is a top view without the top rack being in place, as taken along the line 3—3 of FIG. 1.

Now that the basic elements of the device have been described and the use illustrated, reference may be had to FIGS. 2–5 for more details of an illustrated and preferred embodiment of the invention. As seen in the elevational view of FIG. 1, the bottom rack 20 is formed of an upper portion 20A and a lower portion 20B, each portion being semi-circular with the diameter of the lower portion being greater. Further, as shown in FIGS. 2 and 3, the portions 20A and 20B are each formed of parallel tubes being identified as 20A' and 20A" in FIG. 2. FIG. 3 shows the bottom rack lower portion 20B to be formed of parallel tubes 20B' and 20B". Forming the bottom rack 20 of paralleled portions 20A and 20B permits horizontal bearing members 16A and 18A to extend between the portions so that the bottom rack 20 rotates relative to the frame 10 about an imaginary horizontal axis.

Figure 4:
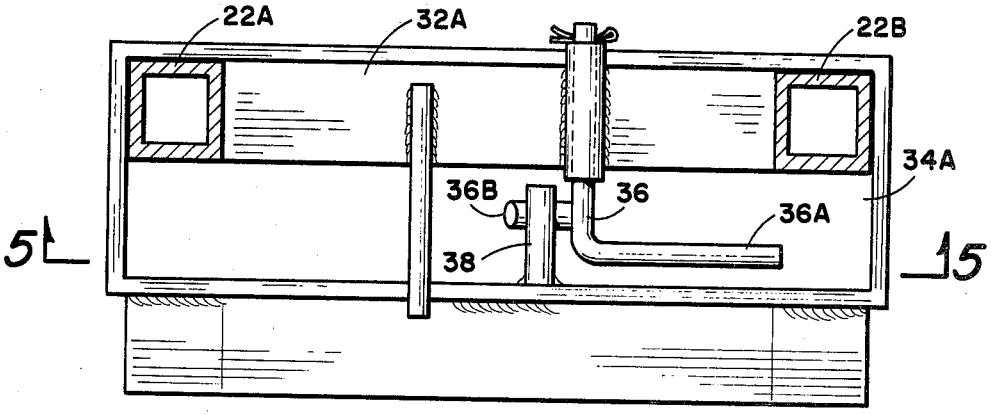
FIG. 4 is a cross-sectional view taken along the line 4—4 of FIG. 1.
Figure 5:
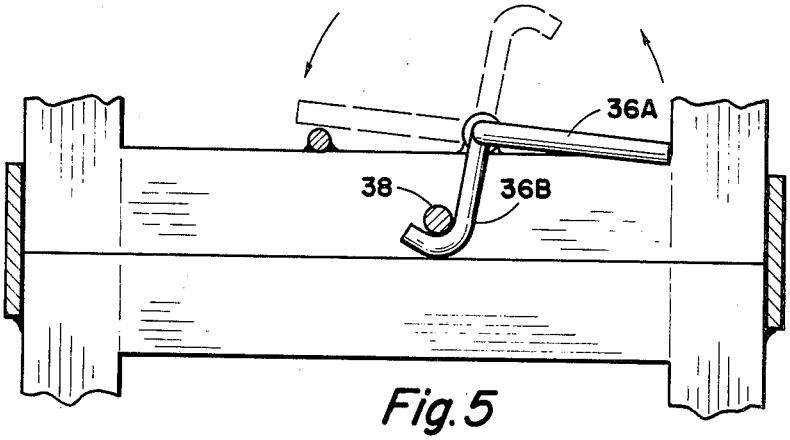
FIG. 5 is a cross-sectional view taken along the line 5—5 of FIG. 4.
Figure 7:
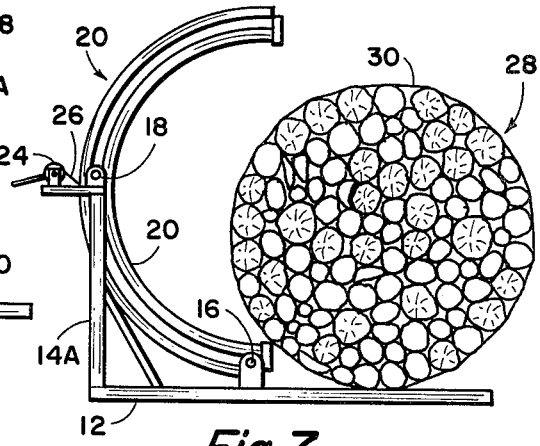
FIG. 7 is a view as in FIG. 6 but showing the bottom rack rotated to discharge the banded bundle of firewood.

The top rack 22 is formed of two parallel curved tubes of square cross-section as shown in FIG. 4, identified as 22A and 22B. The ends of the pairs of tubes 22A and 22B are each provided with plates 32A and 32B which engages plates 34A and 34B affixed to the ends of lower rack 20. These plates enable the device to be removably secured to each other, and FIGS. 4 and 5 show one means wherein this can be accomplished. This arrangement employs a rotatable hook 36 having a handle portion 36A and a hook portion 36B. The hook is rotatably secured to plate 32A and when in the locked position, the hook portion 36B engages a shaft 38 extending from the bottom plate. This is merely an example of one means wherein the upper or top rack 20 may be removably attached to the lower or bottom rack 22. The top rack is placed in position on the lower rack to define the circular area when stacking firewood into position and after the firewood has been banded, is removed before the bottom rack is pivoted as shown in FIG. 7 to remove the banded firewood.

FIG. 3 shows that the frame is formed of two horizontal portions 12A and 12B spaced apart. A cross member 40 supports the first bearing means 16.

Winch 24 is supported at the upper end of the frame vertical portion 14 on the side thereof opposite that of the bottom rack. Winch 24 has a hand crank 42 by which it may be rotated, although it can be seen that, if desired, an electric operated winch may be employed.

The details of the illustrated embodiment are merely exemplary as it is apparent the device can be constructed in a variety of different ways.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. Apparatus for bundling short lengths of generally cylindrical elements, such as firewood, comprising:

a horizontal frame portion adapted to rest on the earth;

a vertical frame portion extending upwardly from one end of said horizontal portion;

a first low elevational bearing support means affixed to said horizontal portion intermediate the length thereof;

a second bearing support means affixed to said vertical portion adjacent the upper end thereof;

a semi-circular bottom rack supported by said first and second bearing support means, the bottom rack being rotatable about its horizontal axis and normally retained in an upper open position;

a semi-circular top rack of internal dimension substantially equal to said bottom rack and removably attachable to said bottom rack in a common plane to form a circular area in which short length generally cylindrical elements such as firewood may be stacked and retained for receiving a band therearound;

and means for rotating said bottom rack about its horizontal axis whereby banded cylindrical items can be easily removed from the bottom rack.

2. Apparatus according to claim 1 including:

a winch supported to said frame, the winch having a cable wound thereon, one end of the cable being affixed to said bottom rack whereby when said cable is wound onto said winch said bottom rack is rotated to discharge banded cylindrical items therefrom.

3. Apparatus according to claim 1 wherein said winch is supported to said frame vertical portion adjacent the upper end thereof and on the side opposite said bottom rack.

* * * * *